US012398440B2

(12) United States Patent
Wang et al.

(10) Patent No.: US 12,398,440 B2
(45) Date of Patent: Aug. 26, 2025

(54) PULSE CURRENT PROCESSING APPARATUS AND METHOD FOR THIN METAL STRIP UNDER BIDIRECTIONAL TENSION

(71) Applicant: TAIYUAN UNIVERSITY OF TECHNOLOGY, Taiyuan (CN)

(72) Inventors: Tao Wang, Taiyuan (CN); Haoran Zhang, Taiyuan (CN); Qi Liu, Taiyuan (CN); Qingshan Ding, Taiyuan (CN); Shufeng Wei, Taiyuan (CN); Wanwan Fan, Taiyuan (CN); Zhongkai Ren, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 304 days.

(21) Appl. No.: 18/162,605

(22) Filed: Jan. 31, 2023

(65) Prior Publication Data

US 2023/0399716 A1 Dec. 14, 2023

(30) Foreign Application Priority Data

Jun. 13, 2022 (CN) ..... 202210665096.8

(51) Int. Cl.
*B21D 25/00* (2006.01)
*C21D 10/00* (2006.01)

(52) U.S. Cl.
CPC ..... *C21D 10/00* (2013.01); *B21D 25/00* (2013.01)

(58) Field of Classification Search
CPC ..... B21D 25/00; B21D 25/04; B21D 3/12
See application file for complete search history.

(56) References Cited

U.S. PATENT DOCUMENTS 3,757,557 A * 9/1973 Kost ..... B21D 3/12 72/302
2020/0391268 A1* 12/2020 Galli ..... B21D 25/00

FOREIGN PATENT DOCUMENTS

CN 108144963 A 6/2018
CN 108723087 A 11/2018

* cited by examiner

*Primary Examiner* — Debra M Sullivan

(57) ABSTRACT

A pulse current processing apparatus includes a bidirectional tension and pulse current application apparatus, a real-time thin metal strip shape detection apparatus and a supporting base. In the apparatus, the tension is applied in the rolling direction and the transverse direction to effectively improve the strip shape flaws of the thin metal strip, and realize the rapid straightening of the thin metal strip; at the same time, the stress status of the thin metal strip is changed by applying the pulse current along the rolling direction or the transverse direction or applying different tensions in two directions; secondly, compared with the conventional heat-preservation heating and annealing apparatus, the pulse current can realize high-efficiency control of mechanical properties of the thin metal strip, and rapidly eliminate the internal stress; further, the strip shape is monitored by the laser ranging to ensure the strip shape consistency of the thin metal strip.

5 Claims, 10 Drawing Sheets

(a) rolled thin strip (b) conventional annealing (c) pulse current processing

PULSE CURRENT PROCESSING APPARATUS AND METHOD FOR THIN METAL STRIP UNDER BIDIRECTIONAL TENSION

CROSS REFERENCE TO RELATED APPLICATIONS

This application claims foreign priority of Chinese Patent Application No. 202210665096.8, filed on Jun. 13, 2022 in the China National Intellectual Property Administration, the disclosures of all of which are hereby incorporated by reference.

TECHNICAL FIELD

The present invention belongs to the technical field of preparation of composite thin metal strips, and particularly relates to a pulse current processing apparatus and method for thin metal strips under bidirectional tension.

BACKGROUND OF THE PRESENT INVENTION

Due to the advantages of uniform thickness, superior surface quality, high hardness, good deep drawability, good resilience, etc., thin metal strips are widely used in industries such as manufacturing, electronics, etc. However, with the increasing demand of precision, light weight and mobility in the manufacturing, electronics and other industries, higher requirements are put forward for the dimensional accuracy of the thin metal strips.

Since strength and hardness of the thin metal strips are improved by means of solid-solution strengthening, ageing strengthening, large-deformation strengthening and other strengthening mechanism, it is difficult to avoid residual stress in all production links; and at the same time, rolling extension of the thin metal strip in a roll gap is non-uniformly distributed along a transverse direction during the rolling, which leads to non-uniform distribution of the residual stress in a rolling direction of a rolled strip along the transverse direction. When the residual compressive stress exceeds a certain limit, the thin metal strip may be destabilized and buckled, resulting in reduction of dimensional accuracy and strip shape defects such as matting lines, double-rib inclined waves, which seriously affects the appearance of finished products and the quality of subsequent processes such as blanking, etching or shaping.

In order to solve the above problems, current methods are to eliminate the residual stress in the thin metal strip by straightening, tension annealing and other processes; and at the same time, microstructures and properties of the thin metal strip are controlled to improve the strip shape quality of the thin metal strip, eliminate the strip shape flaws and improve the comprehensive properties.

The existing thin metal strip straightening equipment mostly adopts arrangement of a multi-roll system, resulting in tension deformation and plastic extension through interaction of stretching and bending so as to achieve straightening effect. At the same time, on-line annealing equipment is used for tension annealing, so as to eliminate the residual stress or control the microstructures and properties. However, the tension of the existing straightening equipment can be applied only along the rolling direction, which has limited effect on improving the strip shape and especially the strip shape perpendicular to the rolling direction. The accurate control of the strip shape by stretching and bending deformation puts forward high requirements on equipment properties and rationality of procedure specifications.

In summary, the straightening equipment and the annealing equipment have the disadvantages of low straightening efficiency, high requirements, and high operation cost, etc.

SUMMARY OF PRESENT INVENTION

In order to solve the disadvantages of the prior art, the present invention provides a pulse current processing apparatus and method for thin metal strips under bidirectional tension, so as to solve the problems of low efficiency in straightening the thin metal strip, low accuracy in controlling a strip shape and high cost in the existing thin metal strip straightening equipment and process.

In order to realize the above purpose, the present invention provides a pulse current processing apparatus for a thin metal strip under bidirectional tension, which includes a bidirectional tension and pulse current application apparatus, a real-time thin metal strip shape detection apparatus and a supporting base; the bidirectional tension and pulse current application apparatus is fixed on an upper surface of the supporting base so as to simultaneously apply rolling and transverse tension and pulse current to a thin metal strip; a fixed column in the real-time thin metal strip shape detection apparatus is fixedly connected with the upper surface and a lower surface of the supporting base through bolts; a through hole is formed in the center of the supporting base so as to measure a strip shape of the thin metal strip by a laser ranging array in the real-time thin metal strip shape detection apparatus; a sealed cavity is sleeved outside a working region formed by the bidirectional tension and pulse current application apparatus, the real-time thin metal strip shape detection apparatus and the supporting base; and the sealed cavity is filled with nitrogen and helium so as to avoid oxidation of the thin metal strip in the working region.

As a further improvement of the above solution, the bidirectional tension and pulse current application apparatus includes a rolling tension and pulse current application apparatus and a transverse tension application apparatus; the rolling tension and pulse current application apparatus applies the rolling tension and pulse current simultaneously to the thin metal strip; the transverse tension application apparatus applies the transverse tension to the thin metal strip; and the rolling tension and pulse current application apparatus and the transverse tension application apparatus are combined to realize rapid straightening of the thin metal strip.

As a further improvement of the above solution, the rolling tension and pulse current application apparatus includes rolling tension application units that are arranged symmetrically; each rolling tension application unit includes a ball guide-way pair and a C-shaped chuck frame; a lower surface of the ball guide-way pair is fixedly connected with the upper surface of the supporting base; a bottom surface of the C-shaped chuck frame is matched with an upper surface of the ball guide-way pair to limit a movement track of the C-shaped chuck frame; an upper arm and a lower arm extending from the C-shaped chuck frame form an action cavity, and an upper top surface of the action cavity is connected with a fixed end of a hydraulic cylinder; a moving end of the hydraulic cylinder is connected with a central hole of an upper pressure plate through threads so as to push the upper pressure plate to clamp the thin metal strip through the hydraulic cylinder; a back surface of the C-shaped chuck frame is fixedly connected with one end of a columnar dynamometer, and the other end of the columnar dynamometer is connected with a moving end of a servo electric cylinder; a fixed end of the servo electric cylinder is fixed on a horizontal position through a fixed support; a bottom surface of the fixed support is fixedly connected with the upper surface of the supporting base so as to pull the C-shaped chuck frame to apply the rolling tension to the thin metal strip through the servo electric cylinder; a vertical end of the fixed support is provided with a linear through hole so as to allow the thin metal strip to pass through; a transfer roll set is fixed on an upper surface of a horizontal end of the fixed support so as to normally transfer the thin metal strip; the forefront end of the lower arm extending from the C-shaped chuck frame is provided with an electrode, and the electrode is connected with an external power supply through a lead wire so as to apply the pulse current to the thin metal strip; and an insulating lining plate is arranged between the ball guide-way pair and the C-shaped chuck frame, and an insulating connector is arranged between the columnar dynamometer and the moving end of the servo electric cylinder, so as to avoid current flowing to other areas except the metal strip.

As a further improvement of the above solution, the transverse tension application apparatus includes transverse tension application units that are arranged symmetrically; each transverse tension application unit includes a ball guide-way pair and a C-shaped chuck frame; a lower surface of the ball guide-way pair is fixedly connected with the upper surface of the supporting base; a bottom surface of the C-shaped chuck frame is matched with an upper surface of the ball guide-way pair to limit a movement track of the C-shaped chuck frame; a bottom surface of an upper arm extending from the C-shaped chuck frame is connected with a fixed end of a hydraulic cylinder; a moving end of the hydraulic cylinder is connected with a central hole of an upper pressure plate through threads so as to push the upper pressure plate to clamp the thin metal strip through the hydraulic cylinder; a back surface of the C-shaped chuck frame is fixedly connected with one end of the columnar dynamometer, and the other end of the columnar dynamometer is connected with a moving end of a servo electric cylinder; a fixed end of the servo electric cylinder is fixed on a horizontal position through a fixed support; a bottom surface of the fixed support is fixedly connected with the upper surface of the supporting base so as to pull the C-shaped chuck frame to apply the transverse tension to the thin metal strip through the servo electric cylinder; and the bottom surface of the upper pressure plate and an upper surface of a lower arm extending from the C-shaped chuck frame are respectively provided with an insulating layer so as to avoid the influence on the pulse current flowing through the thin metal strip.

As a further improvement of the above solution, the real-time thin metal strip shape detection apparatus includes detection units that are vertically arranged symmetrically; each detection unit includes a gantry-type electric high-speed sliding platform and a laser ranging array; a movement track of the gantry-type electric high-speed sliding platform is perpendicular to a movement direction of the thin metal strip; the laser ranging array is fixed on a moving beam in the gantry-type electric high-speed sliding platform and perpendicularly points to the thin metal strip so as to detect the strip shape of thin metal strip.

As a further improvement of the above solution, in the rolling direction tension and pulse current application apparatus, the bottom surface of the upper pressure plate and an upper surface of the lower arm extending from the C-shaped chuck frame are respectively provided with corrugated stripe grooves so as to prevent the slipping of the thin metal strip.

As a further improvement of the above solution, in the transverse direction tension application apparatus, contact surfaces between the insulating layers arranged on the bottom surface of the upper pressure plate and the upper surface of the lower arm extending from the C-shaped chuck frame are respectively arranged as corrugated stripe grooves so as to prevent the slipping of the thin metal strip.

The present invention provides a thin metal strip processing method using the pulse current processing apparatus for the thin metal strip under the bidirectional tension, which specifically includes the following steps:

step I, uncoiling the thin metal strip through cooperation of a coiling machine and an uncoiling machine, and feeding the thin metal strip into a bidirectional stretching area of the bidirectional tension and pulse current application apparatus;

step II, pushing the upper pressure plate to clamp edges of the thin metal strip by using the hydraulic cylinders in the rolling tension and pulse current application apparatus and the transverse tension application apparatus, and then pulling the C-shaped chuck frame by using the servo electric cylinder to apply the rolling tension and the transverse tension to the thin metal strip;

step III, applying pulse current to the thin metal strip by using the electrodes in the rolling tension and pulse current application apparatus so as to control microstructures, strength and toughness of the thin metal strip through the pulse current, and also eliminate residual stress of the thin metal strip;

step IV, measuring a thickness of the thin metal strip in real time through cooperative movement of the laser ranging array and the gantry-type electric high-speed sliding platform that are vertically arranged symmetrically in the real-time thin metal strip shape detection apparatus so as to monitor the strip shape of the thin metal strip in real time, and pulling the C-shaped chuck frame by the servo electric cylinder to adjust the strip shape of the thin metal strip in real time;

step V, releasing the clamping of the thin metal strip by the rolling tension and pulse current application apparatus and the transverse tension application apparatus, then delivering the thin metal strip out of the bidirectional stretching area through the cooperation of the coiling machine and the uncoiling machine, and then removing the edges of the thin metal strip through a blanking process to obtain the thin metal strip with qualified properties.

As a further improvement of the above solution, a clamped width of the thin metal strip in the step II is not greater than 1/10 of a width of the thin metal strip.

As a further improvement of the above solution, in the step IV, the strip shape is scanned by a laser ranging probe to acquire local deflection ($\omega_x$, $\omega_y$) and a thickness (t), and calculate flatness ($\Delta$); and according to an expected set value ($\Delta_1$) of the flatness of the strip shape, when the actual flatness ($\Delta$) and the thickness are decreased to be less than the set value ($\Delta_1$), the tension increase and current output are stopped, and the thin metal strip is cooled under constant tension.

The present invention has the beneficial effects:

Compared with the prior art, the pulse current processing apparatus and method for the thin metal strip under the bidirectional tension provided by the present invention have the following advantages:

(1) The straightening efficiency and the strip shape control accuracy of the thin metal strip are improved.

The tension is applied in the rolling direction and the transverse direction to effectively improve the strip shape flaws of the thin metal strip, and realize the rapid straightening of the thin metal strip; at the same time, the stress status of the thin metal strip is changed by applying the pulse current along the rolling direction or the transverse direction or applying different tension in two directions, so that the anisotropy of texture, microstructures and properties of the thin metal strip is controlled. Furthermore, compared with the conventional heat-preservation heating and annealing apparatus, the pulse current can realize high-efficiency control of mechanical properties of the thin metal strip, and rapidly eliminate the internal stress; and finally, the strip shape monitoring is realized by the laser ranging to ensure the strip shape consistency of the thin metal strip.

(2) The straightening cost of the thin metal strip is reduced.

Compared with a straightening machine equipped in a conventional stretching and bending straightening process, the manufacturing cost of the present apparatus is lower; and at the same time, the rolling tension and pulse current application apparatus is simple in structure, which is conductive to the sealing operation, so that the problems such as oxidation and energy consumption caused by long-term heat preservation can be avoided effectively, and the operation cost is reduced effectively.

Figure 1:
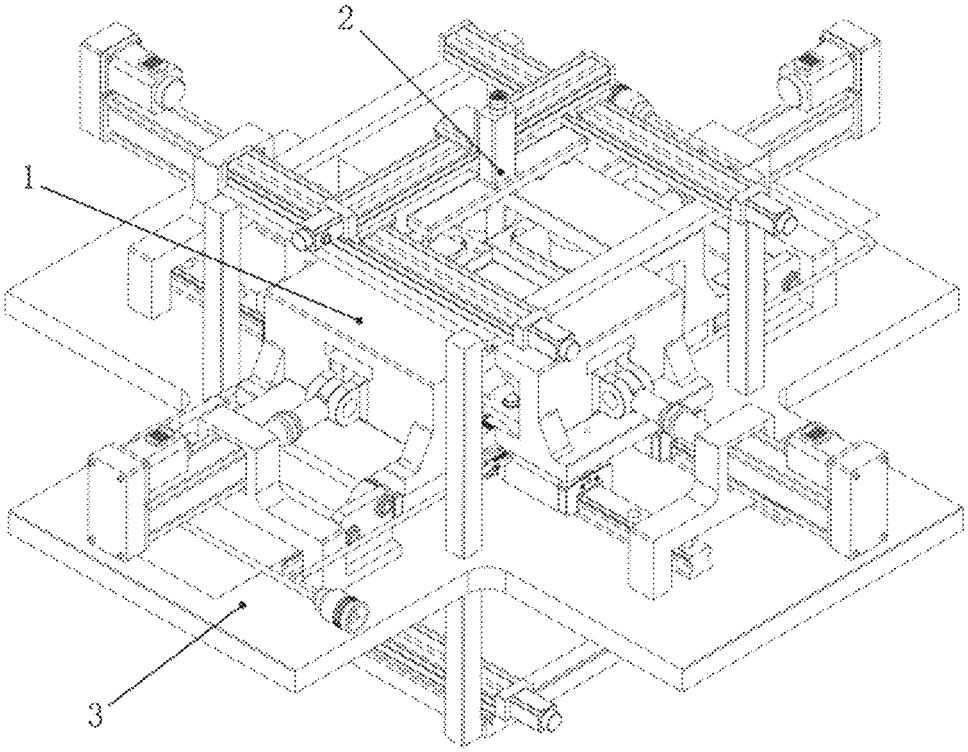
FIG. 1 is a stereoscopic diagram of an apparatus in the present invention.

In the drawings: 1-bidirectional tension and pulse current application apparatus; 2-real-time thin metal strip shape detection apparatus; 3-supporting base; 4-rolling tension and pulse current application apparatus; 5-transverse tension application apparatus; 6-thin metal strip; 7-bidirectional stretching area; 8-servo electric cylinder; 9-fixed support; 11-insulating connector; 12-columnar dynamometer; 13-ball guide-way pair; 14-C-shaped chuck frame; 15-hydraulic cylinder; 16-upper pressure plate; 17-insulating lining plate; 18-transfer roll set; 19-electrode; 20-lead wire; 21-insulating layer; 22-gantry-type electric high-speed sliding platform; 23-laser ranging array; 24-sealed cavity; 25-fixed column.

DETAILED DESCRIPTION OF PREFERRED EMBODIMENTS

Specific embodiments of the present invention are further described below in detail in combination with the accompanying drawings:

The present invention provides a pulse current processing apparatus for a thin metal strip under bidirectional tension, as shown in FIG. 1, which includes a bidirectional tension and pulse current application apparatus 1, a real-time thin metal strip shape detection apparatus 2 and a supporting base 3; the bidirectional tension and pulse current application apparatus 1 is fixed on an upper surface of the supporting base 3 so as to simultaneously apply rolling and transverse tension and pulse current to a thin metal strip 6; a fixed column 25 in the real-time thin metal strip shape detection apparatus 2 is fixedly connected with the upper surface and a lower surface of the supporting base 3 through bolts; and a through hole 7 is formed in the center of the supporting base 3 so as to measure a strip shape of the thin metal strip 6 by a laser ranging array 23 in the real-time thin metal strip shape detection apparatus 2.

Figure 2:
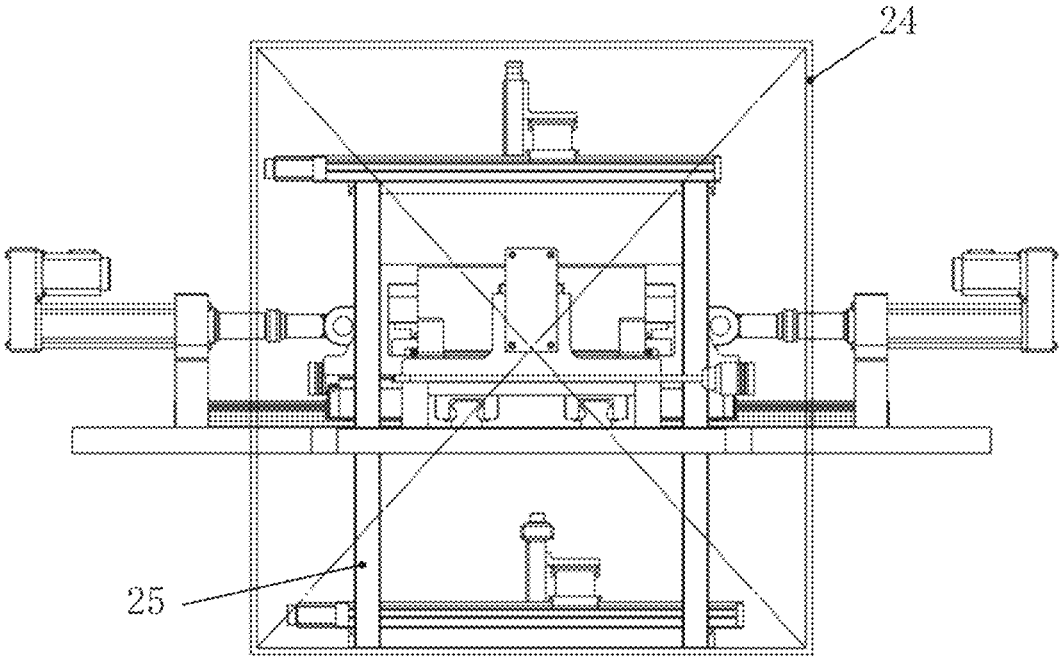
FIG. 2 is a front view of the apparatus in the present invention.

As shown in FIG. 2, a sealed cavity 24 is sleeved outside a working region formed by the bidirectional tension and pulse current application apparatus 1, the real-time thin metal strip shape detection apparatus 2 and the supporting base 3, and the sealed cavity 24 is filled with nitrogen and helium so as to avoid oxidation of the thin metal strip 6 in the working region.

Figure 3:
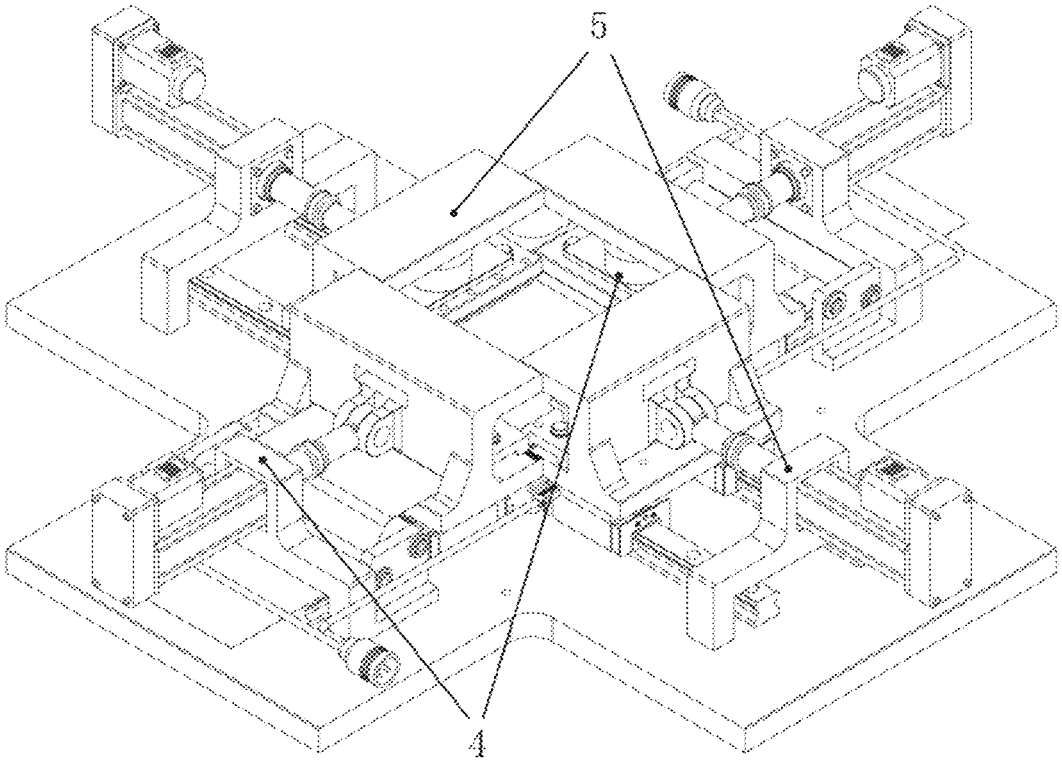
FIG. 3 is a stereoscopic diagram of a bidirectional tension and pulse current application apparatus in the present invention.
Figure 4:
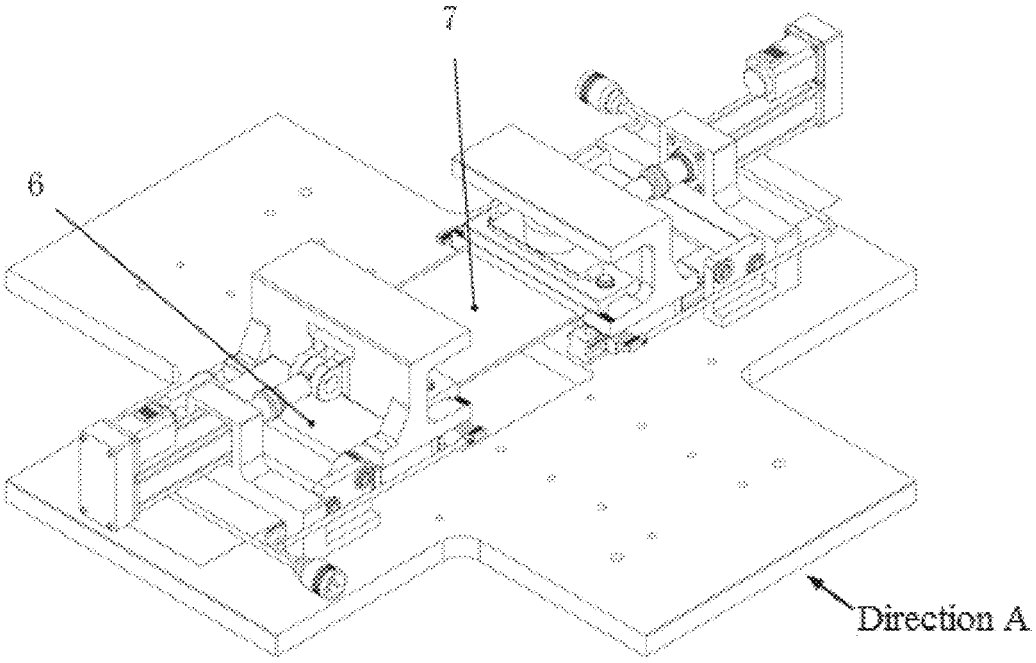
FIG. 4 is a stereoscopic diagram of a rolling tension and pulse current application apparatus in the present invention.
Figure 5:
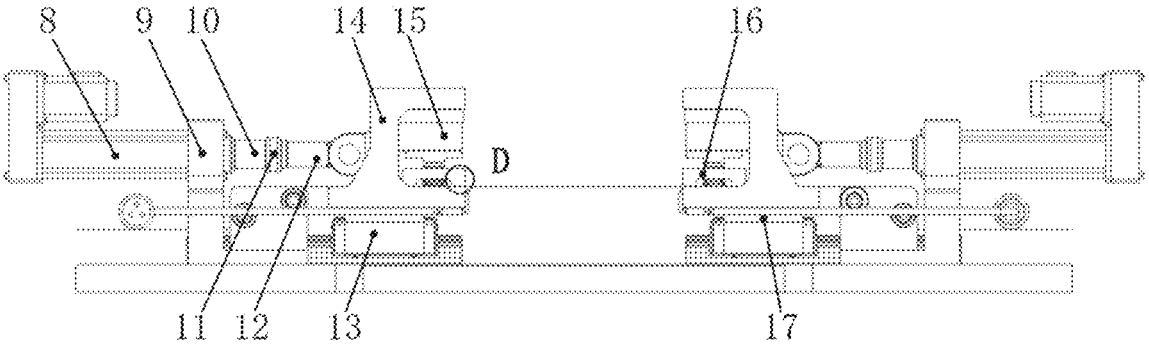
FIG. 5 is a view in a direction A in FIG. 4.
Figure 6:
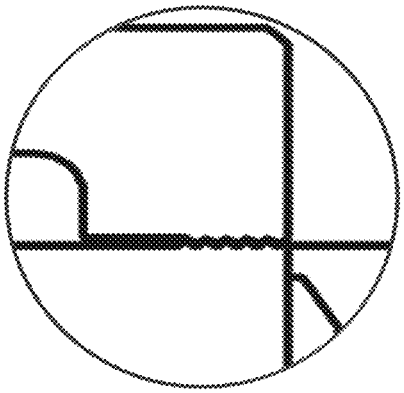
FIG. 6 is a local enlarged view of D in FIG. 5.
Figure 7:
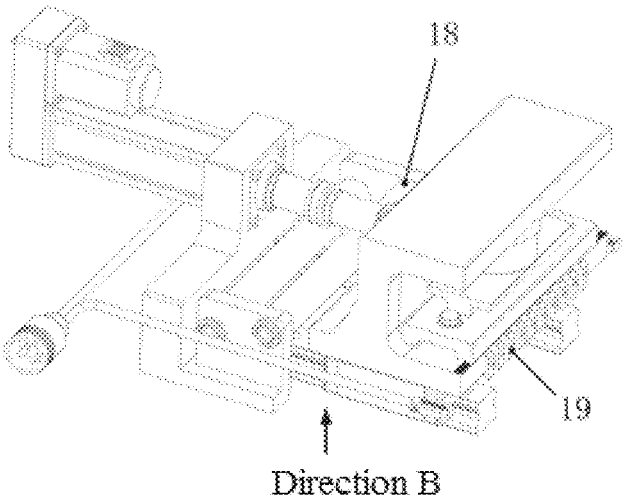
FIG. 7 is a stereoscopic diagram of a rolling tension application unit in the present invention.
Figure 8:
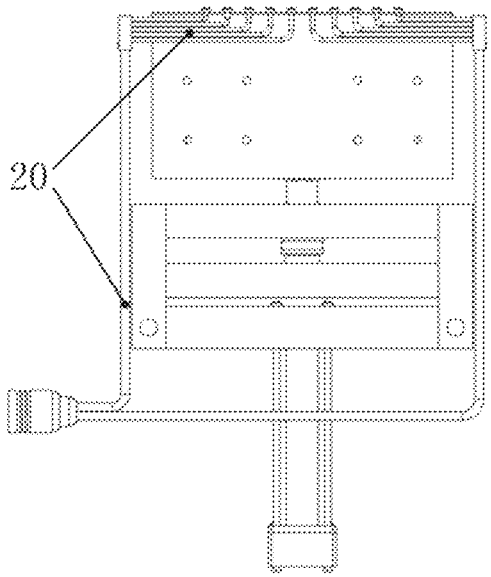
FIG. 8 is a view in a direction B in FIG. 7.

As shown in FIG. 3, the bidirectional tension and pulse current application apparatus 1 includes a rolling tension and pulse current application apparatus 4 and a transverse tension application apparatus 5; the rolling tension and pulse current application apparatus 4 applies the rolling tension and pulse current simultaneously to the thin metal strip 6; the transverse tension application apparatus 5 applies the transverse tension to the thin metal strip 6; and the rolling tension and pulse current application apparatus 4 and the transverse tension application apparatus 5 are combined to realize the rapid straightening of the thin metal strip 6.

As shown in FIG. 4-FIG. 8, the rolling tension and pulse current application apparatus 5 includes rolling tension application units that are arranged symmetrically; each rolling tension application unit includes a ball guide-way pair 13 and a C-shaped chuck frame 14; a lower surface of the ball guide-way pair 13 is fixedly connected with the upper surface of the supporting base 3; a bottom surface of the C-shaped chuck frame 14 is matched with an upper surface of the ball guide-way pair 13 to limit a movement track of the C-shaped chuck frame 14; an upper arm and a lower arm extending from the C-shaped chuck frame 14 form an action cavity; an upper top surface of the action cavity is connected with a fixed end of a hydraulic cylinder 15; a moving end of the hydraulic cylinder 15 is connected with a central hole of an upper pressure plate 16 through threads so as to push the upper pressure plate 16 to clamp the thin metal strip 6 through the hydraulic cylinder 15; a back surface of the C-shaped chuck frame 14 is connected with one end of a columnar dynamometer 12, and the other end of the columnar dynamometer 12 is connected with a moving end 10 of a servo electric cylinder 8; a fixed end of the servo electric cylinder 8 is fixed on a horizontal position through a fixed support 9; a bottom surface of the fixed support 9 is fixedly connected with the upper surface of the supporting base 3 so as to pull the C-shaped chuck frame 14 to apply the rolling tension to the thin metal strip 6 through the servo electric cylinder 8; a vertical end of the fixed support 9 is provided with a linear through hole so as to allow the thin metal strip 6 to pass through; a transfer roll set 18 is fixed on an upper surface of a horizontal end of the fixed support 9 so as to normally transfer the thin metal strip 6; the forefront end of the lower arm extending from the C-shaped chuck frame 14 is provided with an electrode 19; the electrode 19 is connected with an external power supply through a lead wire 20 so as to apply the pulse current to the thin metal strip 6; an insulating lining plate 17 is arranged between the ball guide-way pair 13 and the C-shaped chuck frame 14; and an insulating connector 11 is arranged between the columnar dynamometer 12 and the moving end of the servo electric cylinder 8 so as to avoid leakage of the pulse current.

Figure 9:
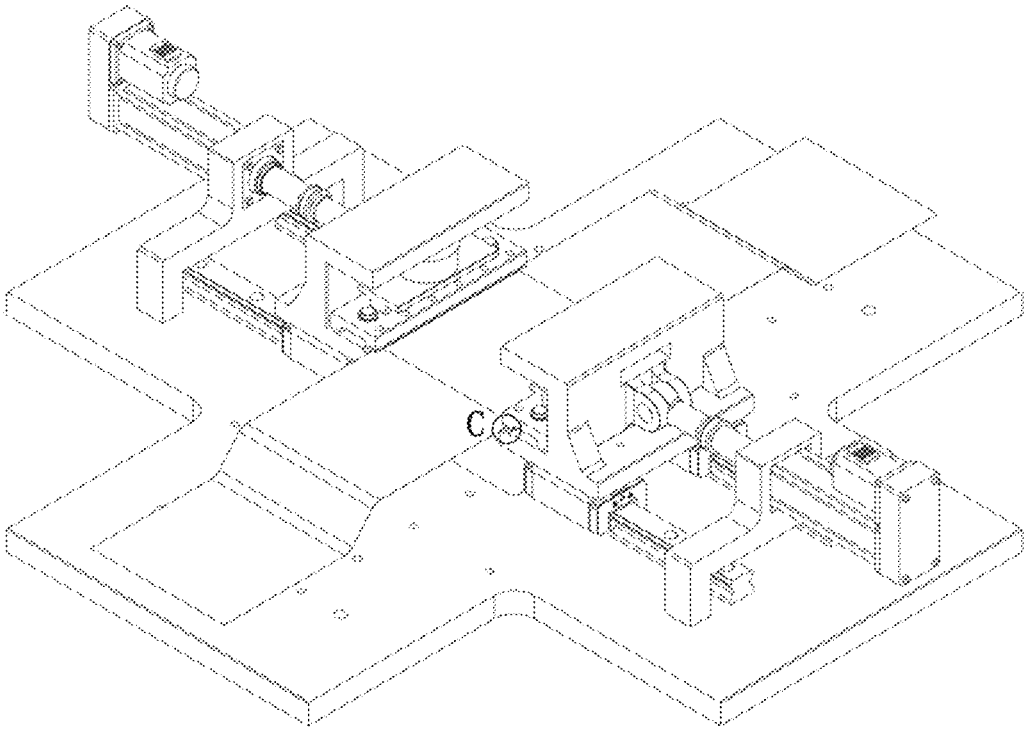
FIG. 9 is a stereoscopic diagram of a transverse direction application apparatus.
Figure 10:
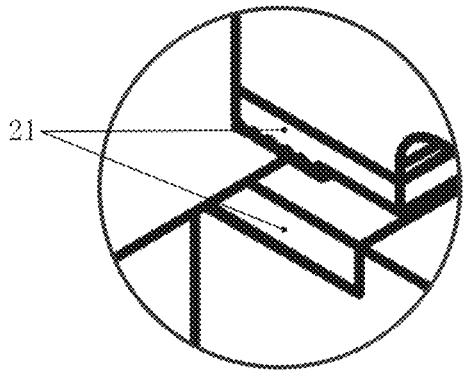
FIG. 10 is a local enlarged view of C in FIG. 9.

As shown in FIG. 9 and FIG. 10, the transverse tension application apparatus 12 includes transverse tension application units that are arranged symmetrically; each transverse tension application unit includes a ball guide-way pair 13 and a C-shaped chuck frame 14; a lower surface of the ball guide-way pair 13 is fixedly connected with the upper surface of the supporting base 3; a bottom surface of the C-shaped chuck frame 14 is matched with an upper surface of the ball guide-way pair 13 to limit a movement track of the C-shaped chuck frame 14; a bottom surface of an upper arm extending from the C-shaped chuck frame 14 is connected with a fixed end of a hydraulic cylinder 15; a moving end of the hydraulic cylinder 15 is connected with a central hole of an upper pressure plate 16 through threads so as to push the upper pressure plate 16 to clamp the thin metal strip 6 through the hydraulic cylinder 15; a back surface of the C-shaped chuck frame 14 is fixedly connected with one end of a columnar dynamometer 12, and the other end of the columnar dynamometer 12 is connected with a moving end of a servo electric cylinder 8; a fixed end of the servo electric cylinder 8 is fixed on a horizontal position through a fixed support 9; a bottom surface of the fixed support 9 is fixedly connected with the upper surface of the supporting base 3 so as to pull the C-shaped chuck frame 14 to apply the transverse tension to the thin metal strip 6 through the servo electric cylinder 8; and the bottom surface of the upper pressure plate 16 and an upper surface of a lower arm extending from the C-shaped chuck frame 14 are respectively provided with an insulating layer 21 so as to avoid the influence on the pulse current flowing through the thin metal strip 6.

Figure 11:
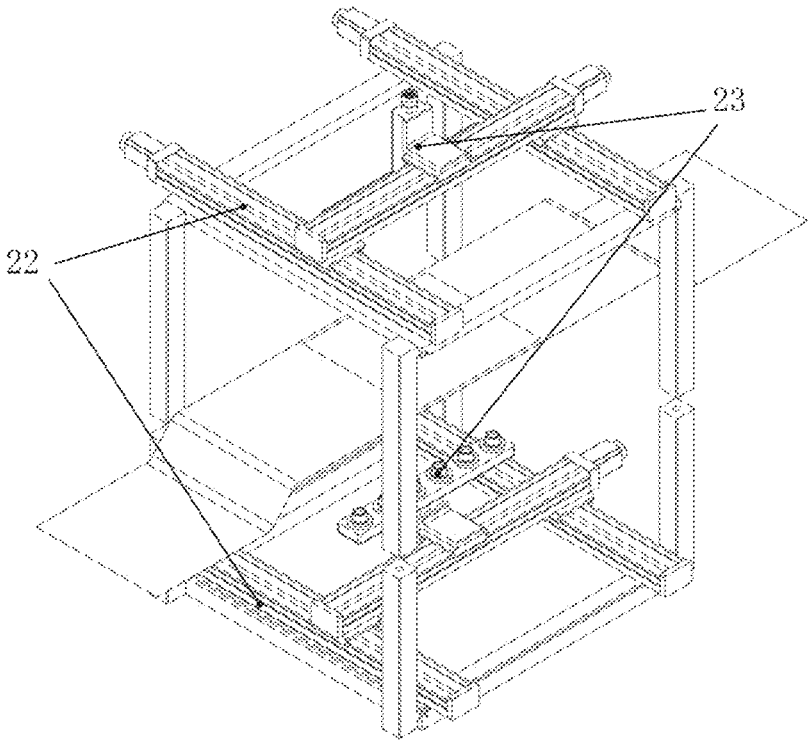
FIG. 11 is a stereoscopic diagram of a real-time thin metal strip shape detection apparatus in the present invention.
Figure 12:
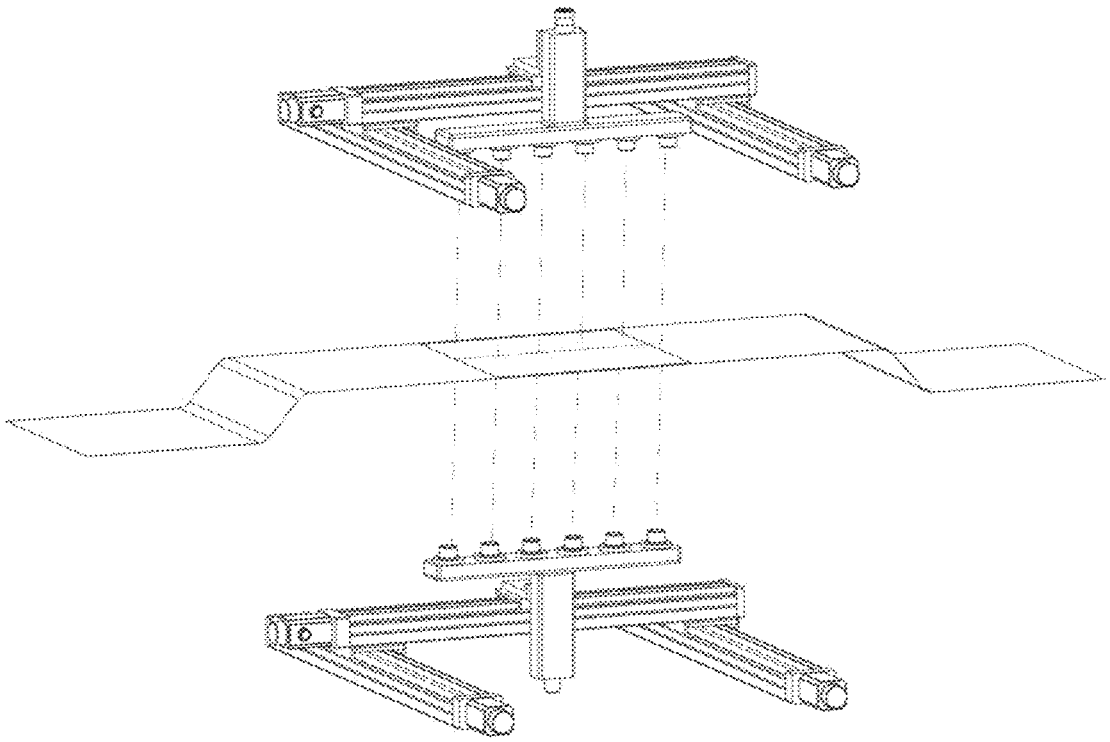
FIG. 12 is an operation schematic diagram of the real-time thin metal strip shape detection apparatus in the present invention.

As shown in FIG. 11 and FIG. 12, the real-time thin metal strip shape detection apparatus 2 includes detection units that are vertically arranged symmetrically; each detection unit includes a gantry-type electric high-speed sliding platform 22 and a laser ranging array 23; a movement track of the gantry-type electric high-speed sliding platform 22 is perpendicular to a movement direction of the thin metal strip 6; and the laser ranging array 23 is fixed on a moving beam in the gantry-type electric high-speed sliding platform 22 and perpendicularly points to the thin metal strip 6 so as to detect the strip shape of the thin metal strip 6.

Figure 13:
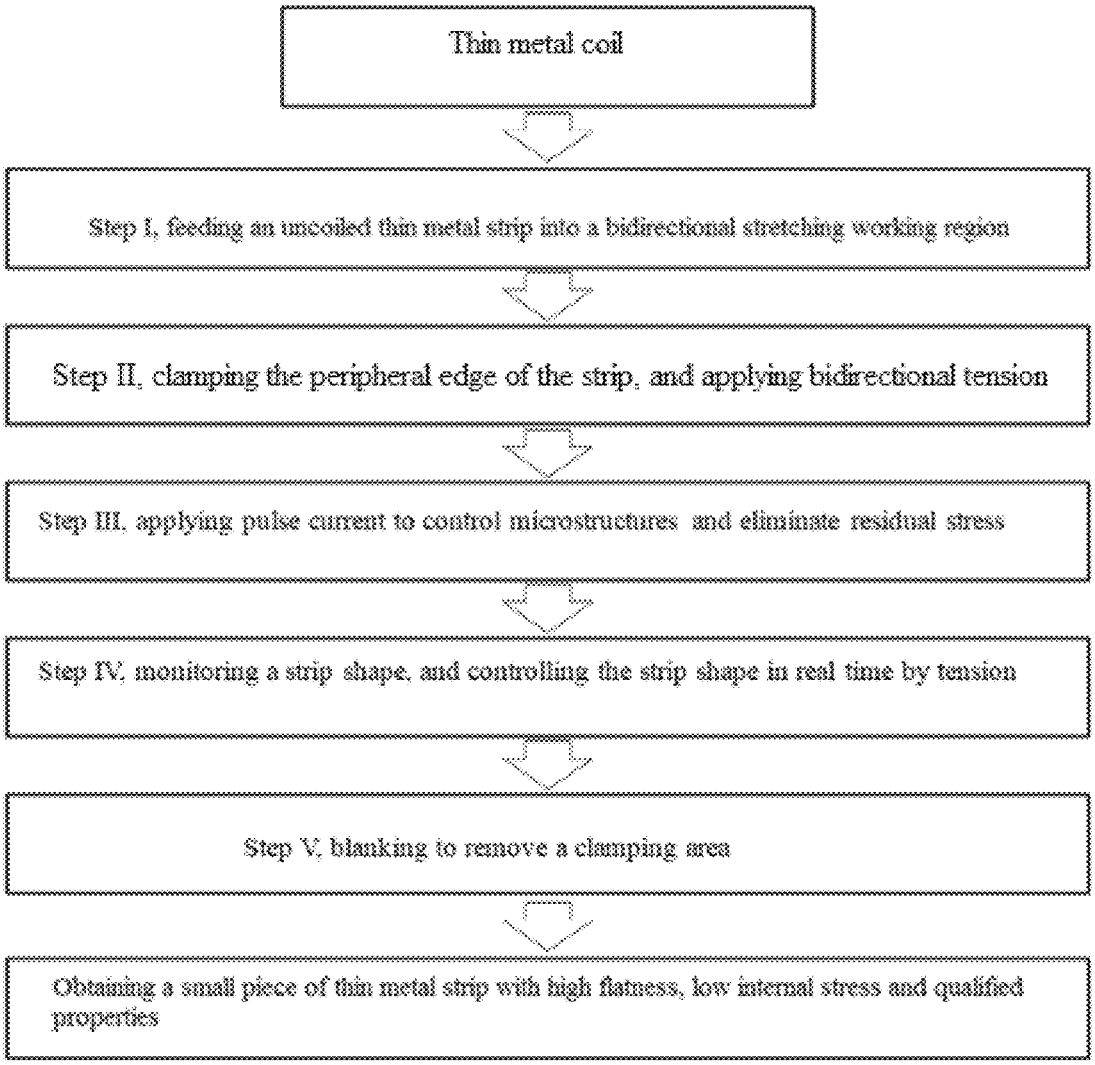
FIG. 13 is a schematic diagram of a method in the present invention.

As shown in FIG. 13, the present invention provides a thin metal strip processing method, which specifically includes the following steps:

Step I, the thin metal strip 6 is uncoiled through cooperation of a coiling machine and an uncoiling machine, and fed into a bidirectional stretching area 7 of the bidirectional tension and pulse current application apparatus 1.

Step II, the upper pressure plate 16 is pushed by the hydraulic cylinders 15 in the rolling tension and pulse current application apparatus 4 and the transverse tension application apparatus 5 to clamp edges of the thin metal strip 6, and a clamped width is not greater than 1/10 of a width of the thin metal strip 6; and then the C-shaped chuck frame 4 is pulled by the servo electric cylinder 8 so as to apply the rolling tension and the transverse tension to the thin metal strip 6.

Furthermore, deflection (ω) and a target thickness (t) are comprehensively considered in advance to determine an allowable value (Δ1) of strip shape flatness. Since a main function of the apparatus is to straighten the strip shape, the flatness is used as an exclusive index to determine whether a straightening process is completed or not.

Step III, the pulse current is applied by the electrode 9 in the rolling tension and pulse current application apparatus 4 to the thin metal strip 6, so as to control microstructures and strength and toughness of the thin metal strip 6, and also eliminate the residual stress of the thin metal strip 6.

Step IV, a thickness of the thin metal strip 6 is measured in real time through cooperative movement of the laser ranging array 23 and the gantry-type electric high-speed sliding platform 22 that are vertically arranged symmetrically in the real-time thin metal strip shape detection apparatus 2 so as to monitor the strip shape of the thin metal strip 6 in real time, and the C-shaped chuck frame 4 is pulled by the servo electric cylinder 8 to adjust the strip shape of the thin metal strip 6 in real time.

Step V, the clamping of the thin metal strip 6 by the rolling tension and pulse current application apparatus 4 and the transverse tension application apparatus 5 is released, then the thin metal strip 6 is delivered out of the bidirectional stretching area 7 by the cooperation of the coiling machine and the uncoiling machine, and then the edges of the thin metal strip 6 are removed by a blanking process to obtain the thin metal strip 6 with qualified properties.

A width range of the thin metal strip 6 is greater than or equal to 20 mm, and a thickness range is 0.01 mm-0.5 mm.

The rolling tension and pulse current application apparatus 4 and the transverse tension application apparatus 5 of the bidirectional tension and pulse current application apparatus 1 can be exchanged in position according to requirements so as to realize a function of applying the pulse current along a rolling direction or a transverse direction of the thin metal strip.

In the steps II and III, initial reference values of the pulse current and tension process parameters when the pulse current assists the post-rolling processing of the thin metal strip under the bidirectional tension are determined according to simulation results.

Figure 14:
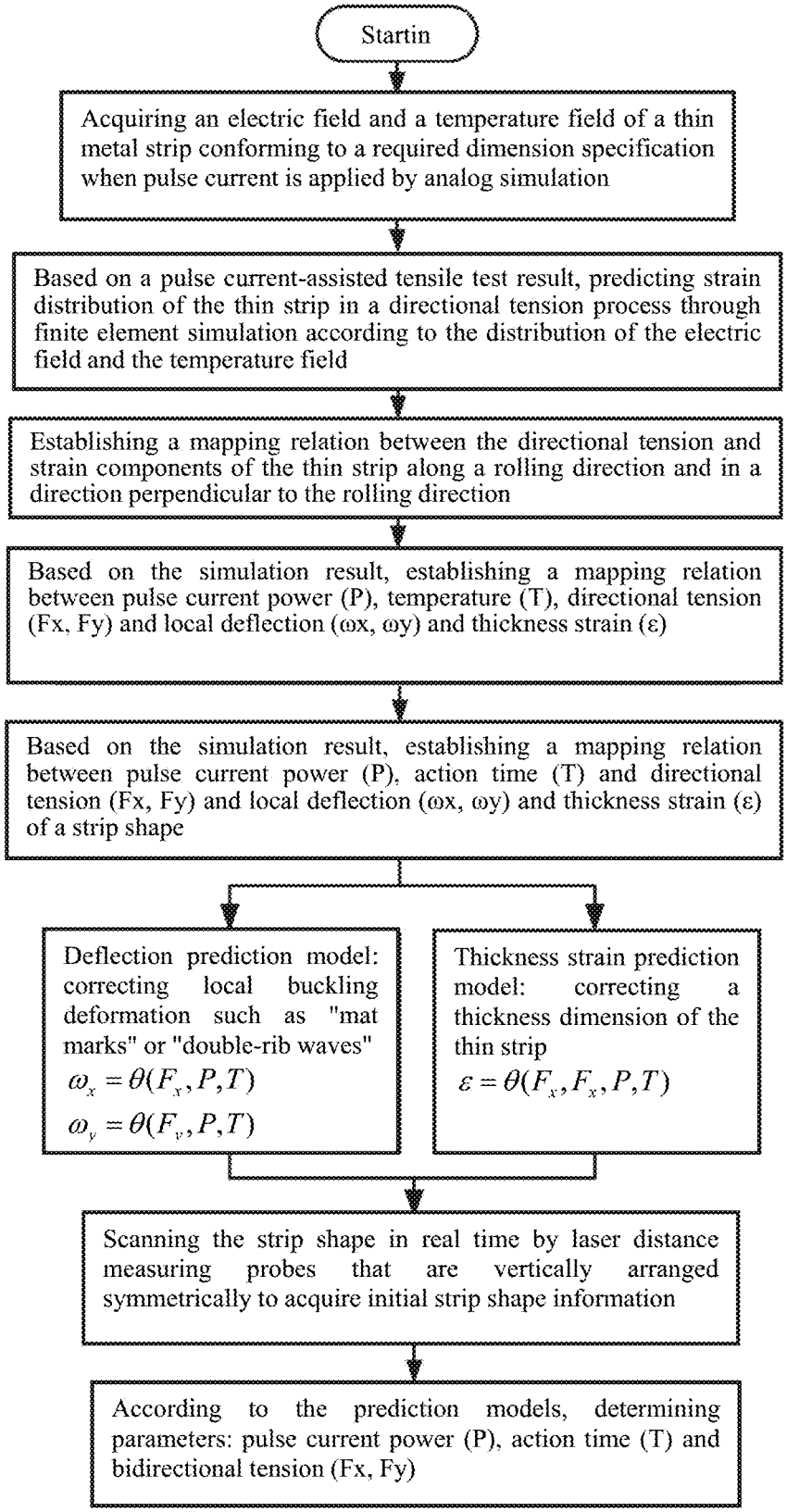
FIG. 14 is a flow chart of the method for determining parameters in the present invention.

As shown in FIG. 14, an accurate numerical simulation plasticity constitutive model is established firstly based on an unidirectional tensile test in the rolling direction and transverse direction assisted by the pulse current with different power, peak current and duty ratios, and then strain distribution of the thin metal strip 6 in the bidirectional tension stretching process is predicted by numerical simulation; the strip shape flaws such as "mat mark", "two-rib wave", etc. are preset in the simulation model to predict a change trend of local deflection along with the tension and pulse current parameters during the bidirectional stretching, thereby establishing a mapping relation between the pulse current power (P), action time (T) and bidirectional tension (Fx, Fy) and local deflection ($\omega_x$, $\omega_y$) and thickness strain (ε) of the strip shape, and obtaining a deflection prediction model (formulas 1, 2) and a thickness strain prediction model (formula 3); and the strip shape is scanned in real time by laser ranging probes that are vertically arranged symmetrically to acquire initial strip shape information, and then the process parameters including the pulse current power (P), the action time (T) and the bidirectional tension (Fx, Fy) are determined according to the prediction models.

$$\omega_x=\theta(F_x,P,T) \quad \text{Formula 1}$$

$$\omega_y=\theta(F_y,P,T) \quad \text{Formula 2}$$

$$\varepsilon=\theta(F_x,F_y,P,T) \quad \text{Formula 3}$$

Figure 15:
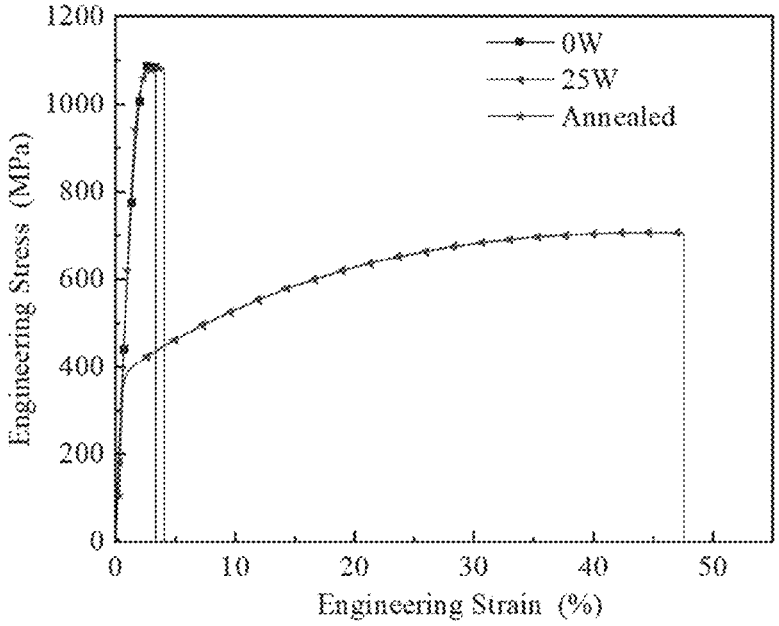
FIG. 15 is a comparison diagram of tensile properties of pulse current processing and conventional annealing processing in the present invention.
Figure 16:
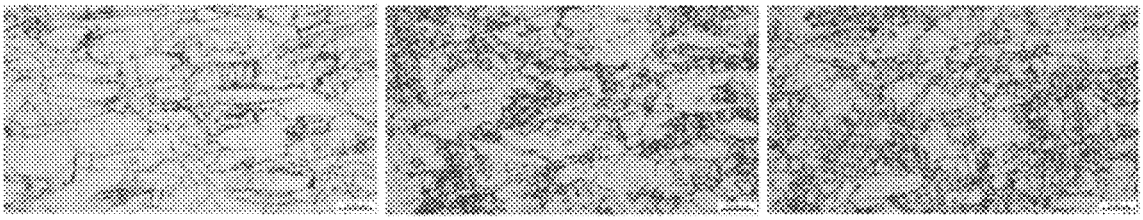
FIG. 16 is a comparison diagram of microstructures of the pulse current processing and the conventional annealing processing in the present invention.

In the step III, the microstructures and properties of the thin metal strip 6 can be efficiently controlled within a short time through the pulse current processing. By taking a thin stainless steel strip with a thickness of 0.05 mm as an example, the microstructures and mechanical properties obtained by processing the thin stainless steel strip for 5 min with the pulse current with power of 45 W, peak current of 300 A and duty ratio of 30% have obvious recrystallization phenomenon compared with the conventional annealing processing for 5 min at the same temperature; the plasticity of the thin stainless steel strip is improved significantly, and the resistance to deformation is reduced significantly, as shown in FIG. 15 and FIG. 16, which is conducive to the subsequent shaping; considering that the pulse current processing does not need heating with a furnace and the processing time is short, the pulse current processing has obvious advantages compared to the conventional heat treatment in terms of post-rolling processing efficiency and energy consumption; at the same time, since the temperature rising occurs only at the thin metal strip 6, the influence on mechanical structures and monitoring equipment is small, which facilitates the implementation of anti-oxidation means; and in combination with the bidirectional tension and pulse current application apparatus 1, on the premise of ensuring the elimination of strip shape flaws, a purpose of removing the residual stress and optimizing the microstructures and properties can be achieved in a short time.

In the step III, the post-rolling processing is carried out through the pulse current, and at the same time, the stress status of the thin metal strip is changed by applying different tension in two directions, so that anisotropy of the microstructures and properties of the thin metal strip is controlled.

In the step IV, the strip shape of the thin metal strip 6 is scanned by the laser ranging array 23 to acquire the local deflection ($\omega_x$, $\omega_y$) and the thickness (t), and calculate the flatness (Δ); and according to an expected set value (Δ1) of the flatness of the strip shape, when the actual flatness (Δ) and the thickness are decreased to be less than the set value (Δ1), the tension increase and current output are stopped, and the thin metal strip is cooled under constant tension.

The above embodiments are not limited to the technical solutions of the embodiments, and various embodiments can be combined with each other to form a new embodiment. The above embodiments are only used for illustrating the technical solutions of the present invention, rather than limiting the present invention. Any modifications or equivalent substitutions without departing from the spirit and scope of the present invention shall fall within the scope of the technical solutions of the present invention.

We claim:

1. A pulse current processing apparatus for a thin metal strip under bidirectional tension, comprising a bidirectional tension and pulse current application apparatus, a real-time thin metal strip shape detection apparatus and a supporting base, wherein the bidirectional tension and pulse current application apparatus is fixed on an upper surface of the supporting base so as to simultaneously apply rolling-direction and transverse tension and pulse current to a thin metal strip; a fixed column in the real-time thin metal strip shape detection apparatus is fixedly connected with the upper surface and a lower surface of the supporting base through bolts; a through hole is formed in the center of the supporting base, the real-time thin metal strip shape detection apparatus comprises a laser ranging array configured for measuring a strip shape of the thin metal strip at the through hole; a sealed cavity is sleeved outside a working region formed by the bidirectional tension and pulse current application apparatus, the real-time thin metal strip shape detection apparatus and the supporting base; and the sealed cavity is filled with nitrogen and helium so as to avoid oxidation of the thin metal strip in the working region.

2. The pulse current processing apparatus for the thin metal strip under bidirectional tension according to claim 1, wherein the bidirectional tension and pulse current application apparatus comprises a rolling-direction tension and pulse current application apparatus and a transverse tension application apparatus; the rolling-direction tension and pulse current application apparatus applies the rolling-direction tension and the pulse current simultaneously to the thin metal strip; the transverse tension application apparatus applies the transverse tension to the thin metal strip; and the rolling-direction tension and pulse current application apparatus and the transverse tension application apparatus are combined to realize rapid straightening of the thin metal strip;

wherein the rolling-direction tension and pulse current application apparatus comprises rolling-direction tension application units that are arranged symmetrically with respect to each other; each rolling-direction tension application unit comprises a first ball guide-way pair and a first C-shaped chuck frame; a lower surface of the first ball guide-way pair is fixedly connected with the upper surface of the supporting base; a bottom surface of the first C-shaped chuck frame is matched with an upper surface of the first ball guide-way pair to limit a movement track of the first C-shaped chuck frame; an upper arm and a lower arm extending from the first C-shaped chuck frame form an action cavity, and an upper top surface of the action cavity is connected with a fixed end of a first hydraulic cylinder; a moving end of the first hydraulic cylinder is connected with a central hole of an first upper pressure plate through threads so as to push the first upper pressure plate to clamp the thin metal strip through the first hydraulic cylinder; a back surface of the first C-shaped chuck frame is fixedly connected with one end of a first columnar dynamometer, and another end of the first columnar dynamometer is connected with a moving end of a first servo electric cylinder; a fixed end of the first servo electric cylinder is fixed in a horizontal position through a first fixed support; a bottom surface of the first fixed support is fixedly connected with the upper surface of the supporting base so as to pull the first C-shaped chuck frame to apply the rolling-direction tension to the thin metal strip through the first servo electric cylinder; a vertical end of the first fixed support is provided with a linear through hole so as to allow the thin metal strip to pass through; a transfer roll set is fixed on an upper surface of a horizontal end of the first fixed support so as to normally transfer the thin metal strip; the forefront end of the lower arm extending from the first C-shaped chuck frame is provided with an electrode, and the electrode is connected with an external power supply through a lead wire so as to apply the pulse current to the thin metal strip; and an insulating lining plate is arranged between the first ball guide-way pair and the first C-shaped chuck frame, and an insulating connector is arranged between the first columnar dynamometer and the moving end of the first servo electric cylinder so as to avoid leakage of the pulse current; and wherein the transverse tension application apparatus comprises transverse tension application units that are arranged symmetrically with respect to each other; each transverse tension application unit comprises a second ball guide-way pair and a second C-shaped chuck frame; a lower surface of the second ball guide-way pair is fixedly connected with the upper surface of the supporting base; a bottom surface of the second C-shaped chuck frame is matched with an upper surface of the second ball guide-way pair to limit a movement track of the second C-shaped chuck frame; a bottom surface of an upper arm extending from the second C-shaped chuck frame is connected with a fixed end of a second hydraulic cylinder; a moving end of the second hydraulic cylinder is connected with a central hole of an second upper pressure plate through threads so as to push the second upper pressure plate to clamp the thin metal strip through the hydraulic cylinder; a back surface of the second C-shaped chuck frame is fixedly connected with one end of a second columnar dynamometer, and another end of the second columnar dynamometer is connected with a moving end of a second servo electric cylinder; a fixed end of the second servo electric cylinder is fixed in a horizontal position through a second fixed support; a bottom surface of the second fixed support is fixedly connected with the upper surface of the supporting base so as to pull the second C-shaped chuck frame to apply the transverse tension to the thin metal strip through the second servo electric cylinder; and the bottom surface of the second upper pressure plate and an upper surface of a lower arm extending from the second C-shaped chuck frame are respectively provided with an insulating layer so as to avoid influence of the pulse current flowing through the thin metal strip.

3. The pulse current processing apparatus for the thin metal strip under bidirectional tension according to claim 1, wherein the real-time thin metal strip shape detection apparatus comprises detection units that are vertically arranged symmetrically with respect to each other; each detection unit comprises a gantry-type electric high-speed sliding platform and the laser ranging array; a movement track of the gantry-type electric high-speed sliding platform is perpendicular to a movement direction of the thin metal strip; the laser ranging array is fixed on a moving beam in the gantry-type electric high-speed sliding platform and perpendicularly points to the thin metal strip so as to detect the strip shape of thin metal strip.

4. The pulse current processing apparatus for the thin metal strip under bidirectional tension according to claim 1, wherein the bottom surface of the first upper pressure plate and an upper surface of the lower arm extending from the first C-shaped chuck frame are respectively provided with corrugated stripe grooves so as to prevent slipping of the thin metal strip.

5. The pulse current processing apparatus for the thin metal strip under bidirectional tension according to claim 1, wherein contact surfaces between the insulating layers arranged on the bottom surface of the second upper pressure plate and the upper surface of the lower arm extending from the second C-shaped chuck frame are respectively arranged as corrugated stripe grooves so as to prevent slipping of the thin metal strip.

* * * * *